US005992114A

United States Patent [19]

Zelinsky et al.

[11] Patent Number: 5,992,114

[45] Date of Patent: Nov. 30, 1999

[54] APPARATUS FOR FORMING A POURED CONCRETE WALL

[76] Inventors: Ronald Dean Zelinsky, 206 N. 4th St., Terril, Iowa 51364; Duane Kent Godfredsen, 25810 Walleye Dr., Spirit Lake, Iowa 51360

[21] Appl. No.: 09/058,933

[22] Filed: Apr. 13, 1998

[51] Int. Cl.[6] ..... E04B 2/30; E04B 2/86

[52] U.S. Cl. ..... 52/426; 52/383; 52/562; 249/34; 249/38; 249/216

[58] Field of Search ..... 52/426, 428, 383, 52/562, 565, 568, 563, 564; 249/34, 38, 42, 45, 47, 190–192, 213, 216

[56] References Cited

U.S. PATENT DOCUMENTS

| | | | |
|---|---|---|---|
| 1,035,206 | 8/1912 | Lewen . | |
| 3,483,665 | 12/1969 | Miller . | |
| 3,772,842 | 11/1973 | Barbera | 52/426 |
| 4,263,765 | 4/1981 | Maloney | 52/562 |
| 4,916,879 | 4/1990 | Boeshart | 52/426 |
| 5,040,344 | 8/1991 | Durand | 52/426 X |
| 5,611,182 | 3/1997 | Spude | 52/426 |
| 5,655,345 | 8/1997 | Thompson . | |
| 5,701,710 | 12/1997 | Tremelling . | |
| 5,709,058 | 1/1998 | Shaw | 52/562 X |
| 5,809,726 | 9/1998 | Spude | 52/426 |
| 5,845,445 | 12/1998 | Blackbeard | 52/426 |

*Primary Examiner*—Robert Canfield
*Attorney, Agent, or Firm*—James R. Cwayna

[57] ABSTRACT

Apparatus for providing an insulated, poured concrete wall which will result, when the concrete is poured, in a wall having internal and external insulation, drywall or other surface preparation connecting areas which are continuous of and extending the entire or selected lengths of the wall and apparatus for the provision of windows into the wall. The apparatus includes a pair of U-shaped lower members attachable to foundation footings to establish the sides of the wall and receive insulating or other material panels, a plurality of H-shaped intermediate members to receive insulating or other material panels which form the pouring area, a pair of U-shaped top members capping the uppermost tier of insulating or other material panels which members may also be utilized to form window openings, a plurality of tie bars frictionally attachable to the H members which provide cross connectors betwen tiers of the panel sections and U-shaped, corner members for both the bottom and top of the wall.

5 Claims, 3 Drawing Sheets

APPARATUS FOR FORMING A POURED CONCRETE WALL

RELATED APPLICATIONS

The applicants have no application on file which should be considered during the prosecution of this application.

SPONSORSHIP

This invention has not been made under any Federal nor any Independent Sponsorship and is the result of the sole effort of the applicants.

FIELD OF THE INVENTION

This invention relates generally to apparatus for providing a form for the pouring of concrete walls or substructures and more particularly to such a form which includes insulating or other forming members which members may become an integral part of at least the interior of the finished wall and may, selectively, become an integral part of the exterior of the finished wall with either or both wall surfaces providing areas to which other building materials may be attached and which will, selectively, afford window openings in the finished wall.

SHORT SUMMARY OF THE INVENTION

The apparatus for providing a form into which concrete is poured to form a concrete foundation or wall and wherein both sides of the wall may be provided with insulating or other selected materials.

In the first step of use of the invention and using normal construction techniques, a footing is provided and the apparatus of the invention which provides the pouring form is erected thereon.

A pair of U-shaped channels are secured to the top of the footing and spaced to the desired wall thickness with right angled or other selectively angled U-shaped channels provided at the respect wall corners or other locations such as at bends in the wall.

Insulating blocks or other generally flat panels are placed into the positioned channels to provide a first tier of the form into which the concrete will be poured. An H-shaped, longitudinally extending member is placed upon the top of this first tier and is thereafter interposed between subsequent tiers. This H member is provided with an inwardly directed male or female connector and a plurality of cross ties, each having an agreeable male or female connector end are affixed to the H members and hold the two walls in spaced apart relation as it is built upwardly. The H members are continuous to effectively hold the insulating blocks or panels and the innermost or outermost surfaces of these members will serve as attachment areas for further wall treatments.

When the proper height of the wall is attained, a second pair of U-shaped members having an inwardly directed male or female connector is provided and joined through the cross ties. Again, the right or selectively angled members are utilized to complete this upper cap.

The U-shaped members may also be utilized to form window or other openings through the wall.

When finished, concrete is poured into the formed opening and all of the members may remain integral to the wall or in certain instances the portions of the H members may be removed and in the case of openings, the U-shaped members may be removed.

BACKGROUND AND OBJECTS OF THE INVENTION

Pouring of concrete walls for basements and the like is not new to the art. The alternatives include laying concrete or other blocks and erecting wooden substructures. Standardly, wooden or metal, flat forms or supports were positioned and held in vertical position on the footings and these members were tied together through various means to withstand the pressure of the concrete poured into the cavity they provide. After setting of the concrete, these forms were removed. This normally provided a rough surface texture and had only the insulating values of the poured concrete. It was also difficult to secure other materials to the surface of the wall.

Applicants have invented a system for providing a pouring area which consists of various formed members to receive restraining wall sections which will retain the concrete until set but which also provides a method for directly insulating bother or either sides of the formed walls, having either or both sides of the wall provided with a selected surface or providing areas to which other surface treatments may be easily attached.

All of the aspects of the Applicants' system greatly improve upon the speed in which a pouring form may be erected, insulation qualities of the completed wall, ease of attaching additional or other selected surfaces to the wall, ease of forming openings for windows and the like in the wall as well as eliminating the investment in permanent steel forms and often unreusable wood forms.

It is therefore an object of the Applicants' invention to provide apparatus and thus a system for providing concrete walls and the like which includes selectively designed panel retaining elements to hold panels of selected materials to establish a pouring area defining the wall.

It is a further object of the Applicants' invention to provide apparatus for pouring of concrete walls and the like which resultant wall rests upon a foundation or footing and is integral therewith.

It is still a further object of the Applicants' invention to provide apparatus system for providing concrete walls and the like which allow the finished wall to have selected surfaces formed integrally therewith.

It is still a further object of the Applicants' invention to provide apparatus for pouring concrete walls and the like which easily accomodates the attachment of selected surfaces to the finished wall.

It is still a further object of the Applicants' invention to provide apparatus for providing concrete walls and the like which allows for openings in the finished wall.

These and other objects and advantages of the Applicants' invention will more fully appear from a consideration of the accompanying disclosure and drawings.

SHORT DESCRIPTION OF THE DRAWINGS

Figure 1:
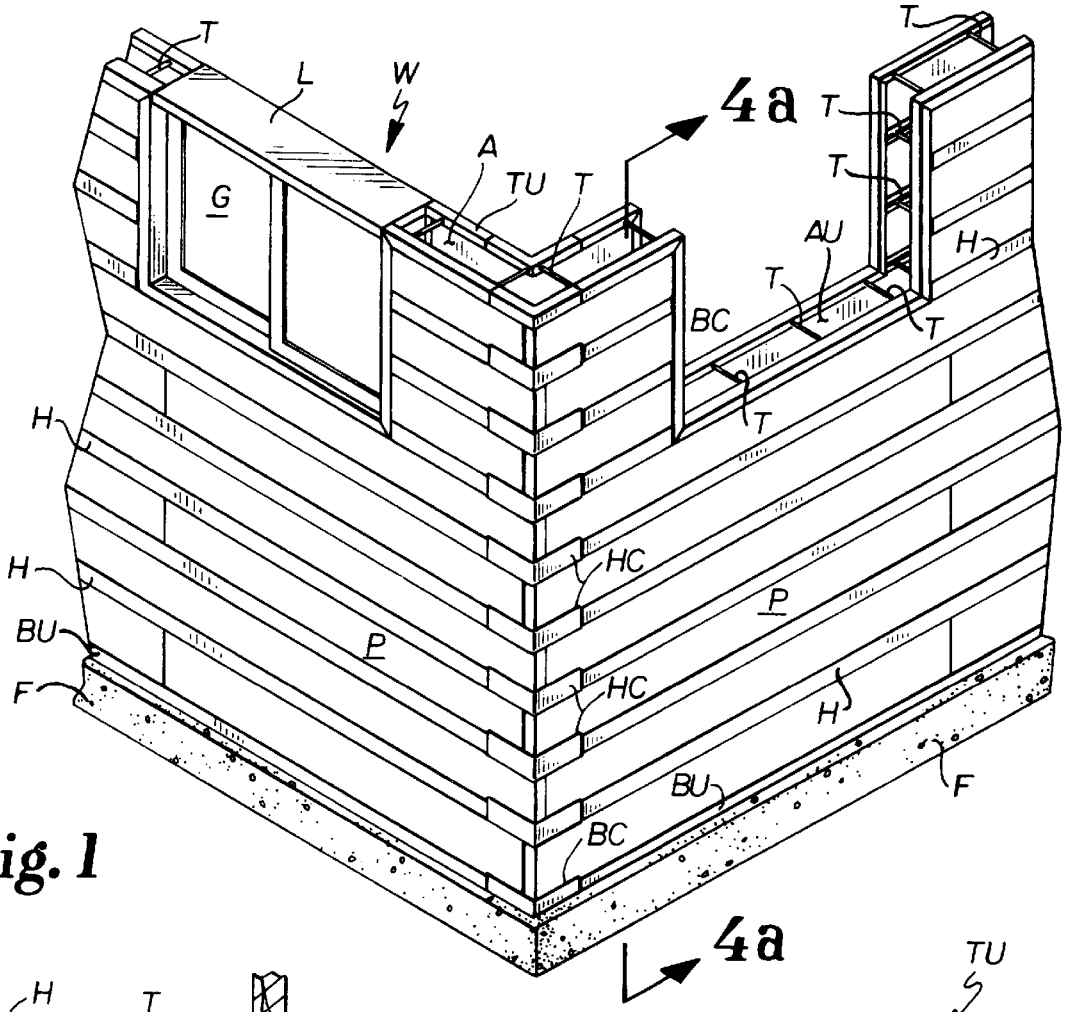
FIG. 1 is a perspective view of a wall pouring area provided with the elements of the Applicants' system located on a footing, illustrating a corner of the wall with the wall and having window openings which are illustrated at the top of the wall but which could be arranged at any wall position.
Figure 4B:
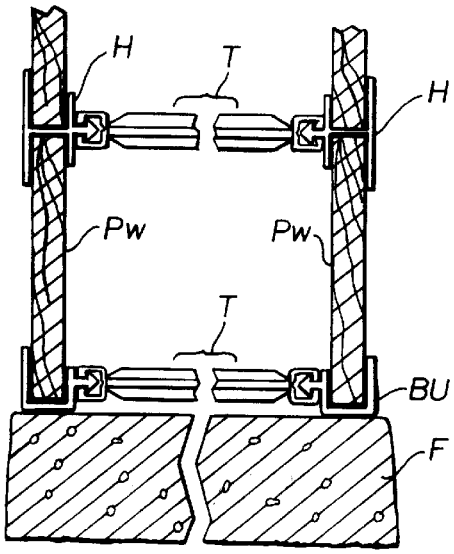
Figure 5:
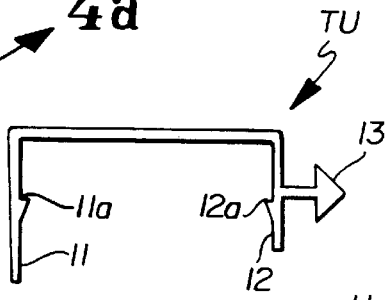
Figure 6:
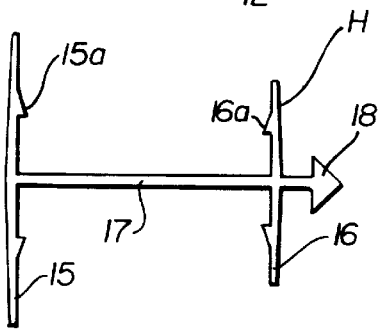
Figure 2:
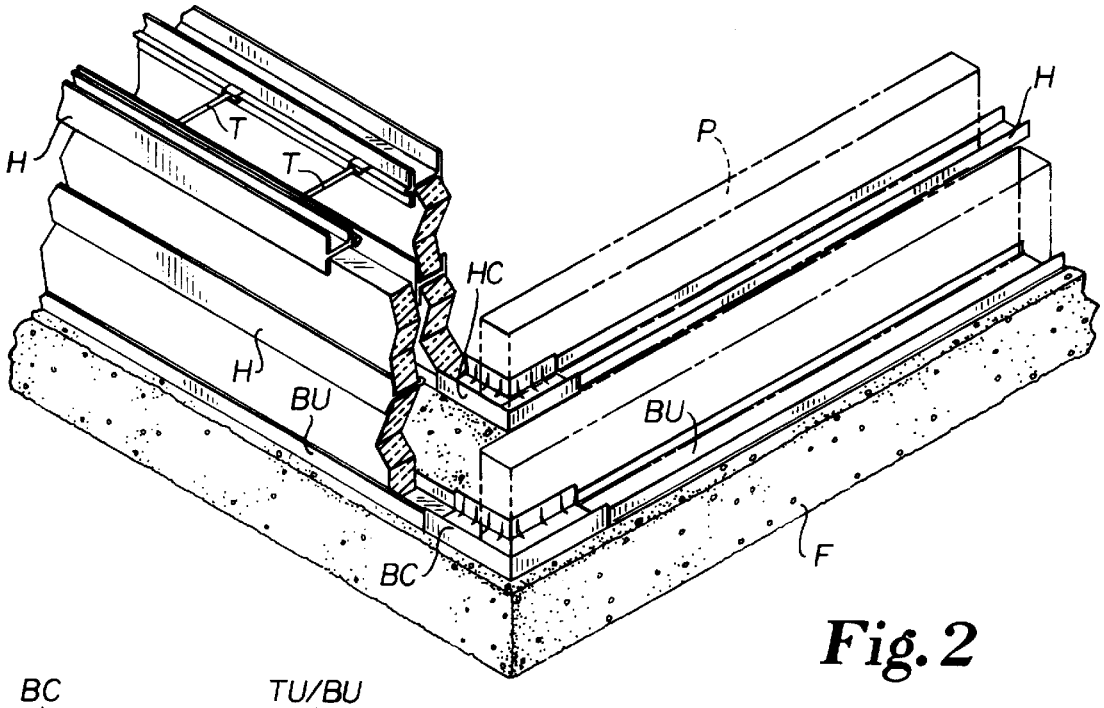
FIG. 2 is a perspective view of a wall portion similar to that of FIG. 1 having portions thereof broken away for clarity.
Figure 3:
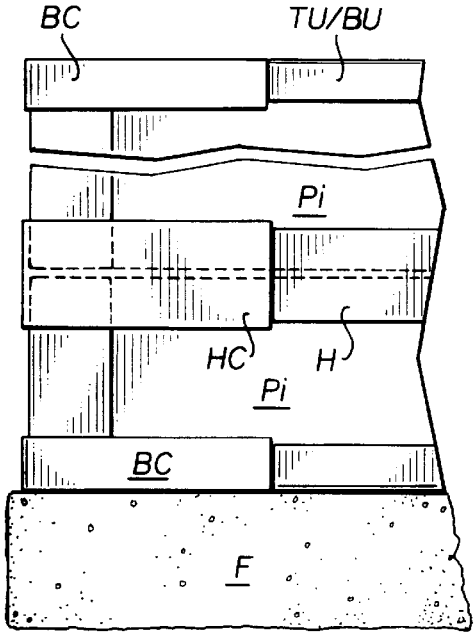
FIG. 3 is an elevation of a typical corner of a forshortened wall illustrating Applicants' components.
Figure 4A:
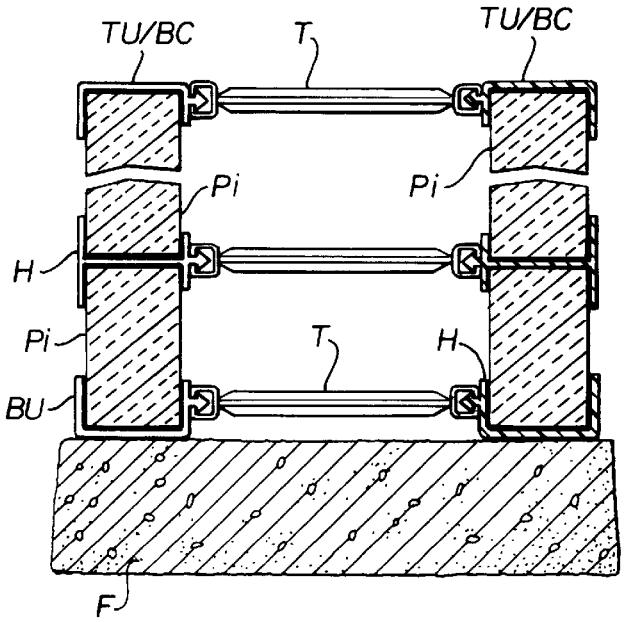
Figure 7:
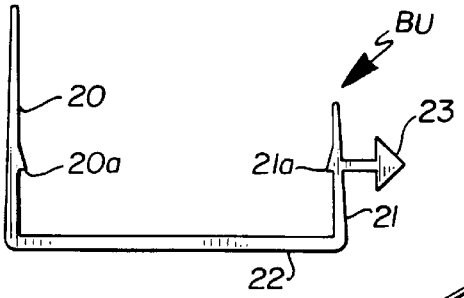
Figure 9:
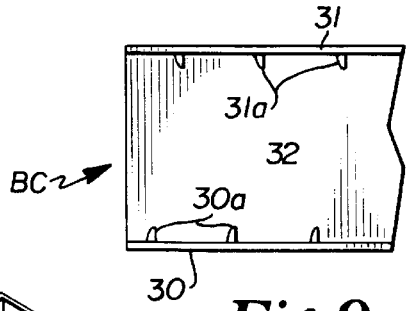
Figure 8:
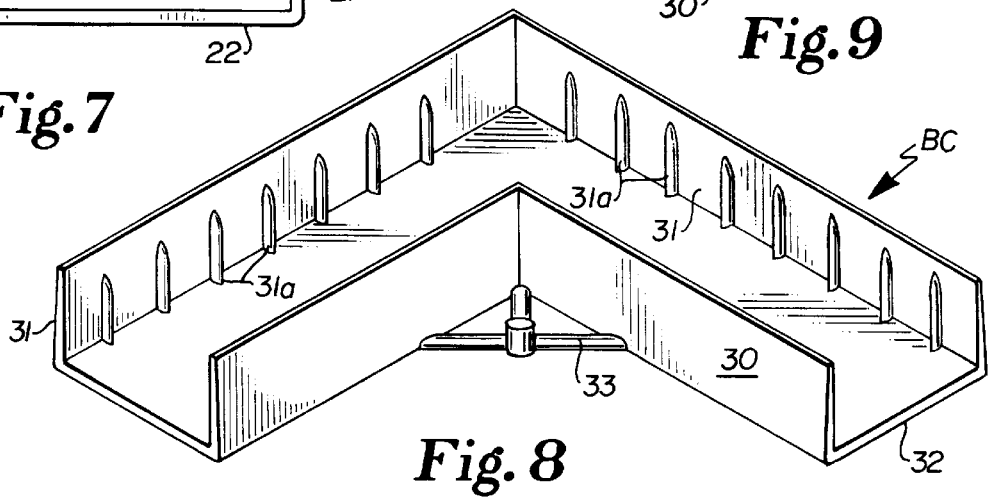
Figure 10:
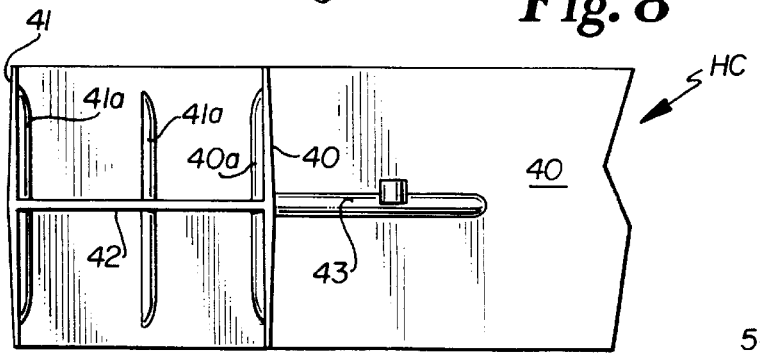
Figure 12:
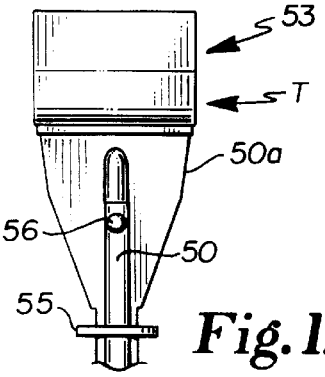
Figure 11:
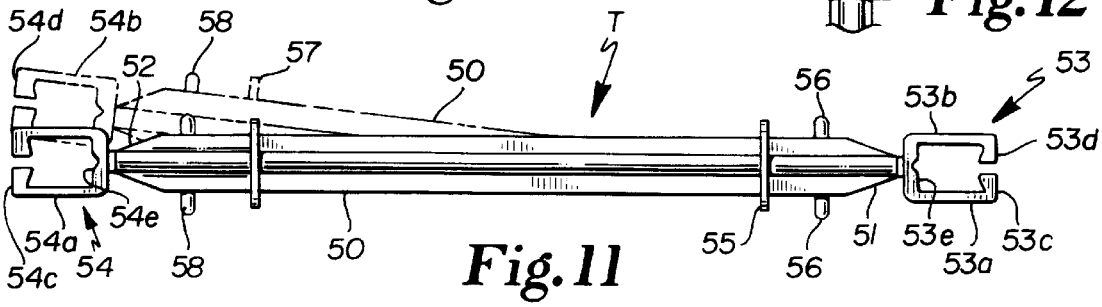

FIG. 4*a* is a forshortened section of a wall taken substantially along Line 4—4 of FIG. 1 utilizing a first thickness of material;

FIG. 4*b* is a view similar to FIG. 4*a* wherein a second thickness of material is illustrated;

FIG. 5 is an end view of a U-shaped channel utilized in Applicants' system which may be used as the uppermost and also window or opening forming element in the pouring area formation;

FIG. 6 is an end view of an H-shaped channel utilized to capture the panels forming the bulk portions of the pouring area;

FIG. 7 is view similar to FIG. 4 showing the U-shaped element of Applicants' system which may be used as the bottommost element and which similarly could be used to form window or other openings;

FIG. 8 is a perspective view of an angled, corner, bottom or top element, it being understood that, although a right angle is illustrated, any selected angle may be provided;

FIG. 9 is a top view of a portion of FIG. 8;

FIG. 10 is an end view of a corner element of one of the H-shaped members of FIG. 6 which particularly illustrates the differentiation in panel holding elements as compared to the normal configuration of such member as shown in FIG. 6;

FIG. 11 is a side view of a cross tie which extends between either the U or H-shaped channels illustrating the flexibility thereof in dotted lines, for ease of joinder to the U or H channels; and, FIG. 12 is a top view of the connector end of a cross tie.

DESCRIPTION OF A PREFERRED FORM OF THE INVENTION

In accordance with the accompanying drawings, FIG. 1 illustrates a typical structure provided by the use of Applicants' apparatus to form the cavity A into which the concrete to form a Wall W will be poured.

As illustrated, a foundation is usually poured separately of the wall W and is designated F. Upon foundation F a first pair of panel receiving members BU are positioned and anchored through any of several selected methods. These panel receiving members BU are spaced laterally upon foundation F in accordance with the thickness of the desired wall. Corner brackets BC are provided at all wall W corners and at any place a wall W may require a bend. When a bend corner is necessary, the angle may be altered from a right to any selected angle. When this bottom set of panel receiving members BU and BC are positioned and secured to foundation F, a first set of panels P are placed therein. Panel types may be of any material as will be discussed hereinafter.

After the first tier of panels P are fitted into the receiving members BU and BC, an intermediate connector H is affitted to the uppermost surface thereof and corner members HC are similarly positioned with, again, the angle being selectable as determined by the desired wall configuration. As illustated and described hereinafter, these H connectors will normally extend the entire length of the wall W between the corner connectors HC to sufficiently support the panels P. Additional panels P are then placed into the upper opening of the H connector and the two spaced walls proceed upwardly to a desired height by providing succeeding tiers of panels P and H and HC connectors.

It should be stated that each of the interior surfaces of the H connectors will include a male or female connective member for tying the two walls together. Such tie members will be described hereinafter but are designated T in FIG. 1 and are illustrated in several places.

When the height of the wall W is achieved, the uppermost tier of panels P is capped by another pair of panel retainers TU and corner connectors which may be identical to the bottom corners and are so designated as BC. Similarly, although TU is utilized to designate the uppermost panel capping member and may be different that member BU, these members may be identical.

If windows, designated G on FIG. 1, the area of location is designated and the panels P terminate at such point. Elements BU or TU may be used to outline the window opening G and it should be obvious that panels must be cut to fit between such members as a barrier to concrete flow and a lintel L would feasibly cap such an opening. This same consideration and arrangement would be provided for doors within the wall.

The completed structure now is ready for pouring concrete and concrete is simply poured to totally fill the void A between the spaced and tied panels P.

Basically, FIGS. 1, 2, 3, 4*a* and 4*b* are illustrateive of wall sections into which all of the aforementioned articles are included with the primary diffecrerence being in selection of the panels P. In FIGS. 4*a* and 4*b* different thicknesses of panels are depicted and are designated Pi and Pw to designate not only a width differentiation but also a material differentiation, Pi indicating that an insulating material may be utilized and Pw indicating that a wood or different material may be utilized without departing from the scope of the invention. Normally, panels of a single structure would be of a single width and therefore all the members BU, BC, H., HC and TU would be commonly sized but there may be instances that require different structures, insulated or non-insulated walls and even some insulated and some non-insulated walls. Applicants' design allowa for accomodation of these and other desired modifications without departing from the scope of the invention.

Referring to specific views by which to describe the various elements provided by the Applicants, the uppermost cap TU is illustrated in FIG. 4 and consists of a generally U-shaped element having a pair of legs 11, 12 with a base member 13 therebetween. As illustrated, the legs 11, 12 may be of different lengths and each is provided with a panel retaining or gripping, inwardly directed friction device 11*a*, 12*a*. As illustrated, a male connector, which may be termed a single tree stem 13 is provided on, in this instance, the shorter leg 12 of the member. Tree connectors, often referred to a Christmas Tree connectors are well known. This element, TU, is normally continuously extruded and cut to length for use. The connector element 13 then is continuous along leg 12 as are the friction devices 11*a*, 12*a*. Applicants' reason for having a longer leg, in this instance 11, is to provide a larger attachment area for selected wall materials which may be ultimately attached to the wall, whether it is initially provided as an insulating material Pi or wood Pw wall.

The second element described is illustrated in FIG. 6 and designated H. Element H consissts of, again, a continuous extrusion having a pair of spaced sides or legs 15, 16 with a cross member 17 therebetween. In the form shown, leg 15 is greater than leg 16 and will normally be arranged interior of the wall W with, again, the male, single tree stem 18 being inwardly directed towards the other formed concrete cavity wall. The aspect of the longer leg 15 is to provide a large attachment area on the inner surface. Again, this member H will have the tree stem 18 along its entire length.

FIG. 7 illustrates the bottom extrusion BU which may be the same size as element TU but in the form shown a slightly large unit is illustrated. This member BU provides a U-shaped extrusion consisting of a pair of legs 20, 21 and cross member 22 with leg 20 being larger than leg 21. Each of the legs 20, 21 is provided with internal friction members 20*a*, 21*a* and a male, tree stem connector 23 is provided on the exterior of leg 21. As stated, this member could be the same as element TU and could be used interchangeably therewith. This element BU is also a continuous extrusion and cuttable to desired length.

FIGS. 8 and 9 are directed to corner units and have been designated BC. As illustrated, the selected angle is a right angle but this may be modified to a smaller or larger angle depending upon the desired wall configuration. This element BC consists of a U-shaped, molded member having legs 30, 31 and a cross member 32. The legs, 30, 31 are each provided with internal, upstanding friction or gripping members 30*a*, 31*a* for added friction contact with the panels P that are placed therein. This corner unit BC may be used at the lowermost or uppermost portion of the wall W. As illustrated, a gusset 33 or other strengthening element is provided between inner legs 30 of the unit.

FIG. 10 illustrates only an end view of an H section corner member previously identified HC. Sides walls 40, 41 are provided as well as the cross member 42. Vertically arranged friction members 40*a*, 41*a* are provided on the respective interior walls of sides 40, 41 and a gusset or strengthening member 43 is provided between the inner walls 40 of the corner. This element as with corner BC may be modified to any desired angle.

The tie which is positioned between the BU, TU and H sections is illustrated in FIGS. 11 and 12 and designated in its entirety, T. The cross section of this element T is basically an x or + section and may have equal or unequal arms. Each end of the body is specifically shaped as illustrated in FIGS. 11 and 12. FIG. 11 is a side elevation and illustrates a longitudinally extending body 50 tapered at its respective ends 51, 52 to a snap, female connector end 53, 54. Each of the female snap connectors 53, 54 include a pair of legs 53*a*, 53*b*, 54*a*, 54*b*, having closure teeth 53*c*, 53*d*, 54*c*, 54*d* with each of the legs 53*a*, 53*b*, 54*a*, 54*b* stemming from a common side 53*e*, 54*e*. The spreadability and memory of these female snap connectors 53, 54 allow the same to receive and positively retain the aformentioned male tree members 13, 18, 23 therein. As illustrated, the flexibility of the tie T allows for the body 50 to be flexed to accommodate the connection between walls. As illustrated in FIG. 12, the body end 50*a* may be enlarged to encompass the entire width of the snap connectors 53, 54. In actual usage, the body 50 of tie T is sufficiently flexible to be bent in either the direction illustrated in FIG. 11 or at right angles thereto to afford the required male to female connection to be made.

A further aspect of tie T is the two pair of outstanding, locating members 55, 56, 57, 58 along body 50. The purpose of such outstanding members is for the locating of reinforcement bars or rebars as they are commonly known. These are metal bars placed for concrete strengthening and would be placed into the structure while the same is being formed.

Obviously, although the individual members may be formed of plastic materials through extrusion or modling processes, they must be of sufficient strength to effectively hold the formed, spaced walls against the hydraulic forces of the conrete pouring.

It has been described that what would be the finished wall interior surface has been provided with the larger leg sections of either the BU, TU or H sections. If additional materials are to be applied to the wall, insulated or non-insulated, it will be necessary to attach such material to the wall and this larger area will provide a very locatable area for dry wall screws or the like.

It should also be noted that if the panels are of wood, simply removing the inner leg sections of the BU, TU, H and corner sections could result in a wall that does not require further finishing.

It should be obvious that the Applicants have provided a new and unique apparatus for the formation of concrete walls which takes into consideration, at least, rapidity and ease of assembly as well as wall configurations.

What is claimed is:

1. Apparatus for forming a poured, generally vertical concrete wall, including:

a. a concrete footing of predetermined width and having a generally flat upper surface;

b. a first pair of generally U-shaped, longitudinally extending members spaced laterally on and attached to said upper surface of said footing;

c. first longitudinally extending panel members of a predetermined width and selected material received into said U-shaped members and providing an upper edge;

d. a first pair of generally H-shaped, longitudinally extending members, each providing a pair of opposed cavities having one cavity thereof positioned on and receiving said upper edge of one of said panel members and positioned to receive additional panel members in the opposite cavity thereof;

e. second, longitudinally extending panel members receivable into said opposite cavity of said H-shaped members to be in substantially vertical relation with said first pair of panel members;

f. additional pairs of H-shaped members and panel members arranged in sequential vertical relation to one another to a desired wall height having panel edges exposed at such height;

g. a second pair of U-shaped members positioned on and receiving said uppermost panel edges;

h. said first pair and each additional pair of said H-shaped members being provided with connector members on one side thereof whereby said connector members of said first pair and each of said additional pairs of said H-shaped members are in opposed relation to each other;

i. extending tie members having connector means on the ends thereof connectable with said connector members of said H-shaped members whereby said H-shaped members and said panels are held in spaced relation to provide a concrete receiving cavity therebetween;

j. said connector members of said H-shaped members including a christmas tree connection element; and, k. each of said tie members including a longitudinally extending body and a cooperative, connectable christmas tree element on the respective ends thereof.

2. The apparatus as set forth in claim 1 and said second pair of U-shaped members including a christmas tree connection element on one side thereof arranged and constructed for connection to said correctable christmas tree element of said tie members whereby said second pair of U-shaped members are held in spaced apart relation.

3. The apparatus as set forth in claim 1 and said christmas tree connection elements including male and a female elements, said female elements including a pair of biased leg members having grasping ends for engaging select portions of said male elements.

4. The apparatus as set forth in claim 1 and each of said tie members including a pair of rebar locating elements along said body whereby a rebar may be positioned on said tie members.

5. The apparatus as set forth in claim 1 and said tie members having a generally X-shaped cross section through said body.

* * * * *